United States Patent [19]

Ponghis et al.

[11] 3,955,963

[45] May 11, 1976

[54] METHOD OF REDUCING ORE

[75] Inventors: Nicolas Gerassimos Ponghis, Liege; Arthur Gerard Poos, Embourg, both of Belgium

[73] Assignee: Centre de Recherches Metallurgigues-Centrum voor Research in de Metallurgie, Brussels, Belgium

[22] Filed: May 17, 1974

[21] Appl. No.: 471,171

[30] Foreign Application Priority Data

May 18, 1973 Belgium ..... 799791

[52] U.S. Cl. ..... 75/40; 75/11; 75/42; 75/91; 219/10.65

[51] Int. Cl.[2] ..... C22D 7/00

[58] Field of Search ..... 75/41, 42, 91, 40, 10, 75/11

[56] References Cited

UNITED STATES PATENTS

| | | | |
|---|---|---|---|
| 975,625 | 11/1910 | Martin | 75/42 |
| 1,010,490 | 12/1911 | Frick | 75/41 |
| 1,917,642 | 7/1933 | Furnas | 75/41 |
| 2,559,213 | 7/1951 | Edwin | 75/41 |
| 2,952,533 | 9/1960 | Cuscoleca et al. | 75/42 |
| 3,764,299 | 10/1973 | Wenzel | 75/42 |
| 3,814,404 | 6/1974 | Claflin | 75/42 |

*Primary Examiner*—M. J. Andrews
*Attorney, Agent, or Firm*—Holman & Stern

[57] ABSTRACT

Ore (e.g. iron ore) and coke are fed continually into the top of a shaft furnace, and molten metal and slag collect in a hearth from which they are tapped periodically. A reducing gas at 800° to 1200°C is injected into the furnace at the bottom of the shaft, preferably into the lower part of the reserve zone. An inert gas at 1700° to 2500°C is injected into the furnace at the top of the hearth.

7 Claims, 1 Drawing Figure

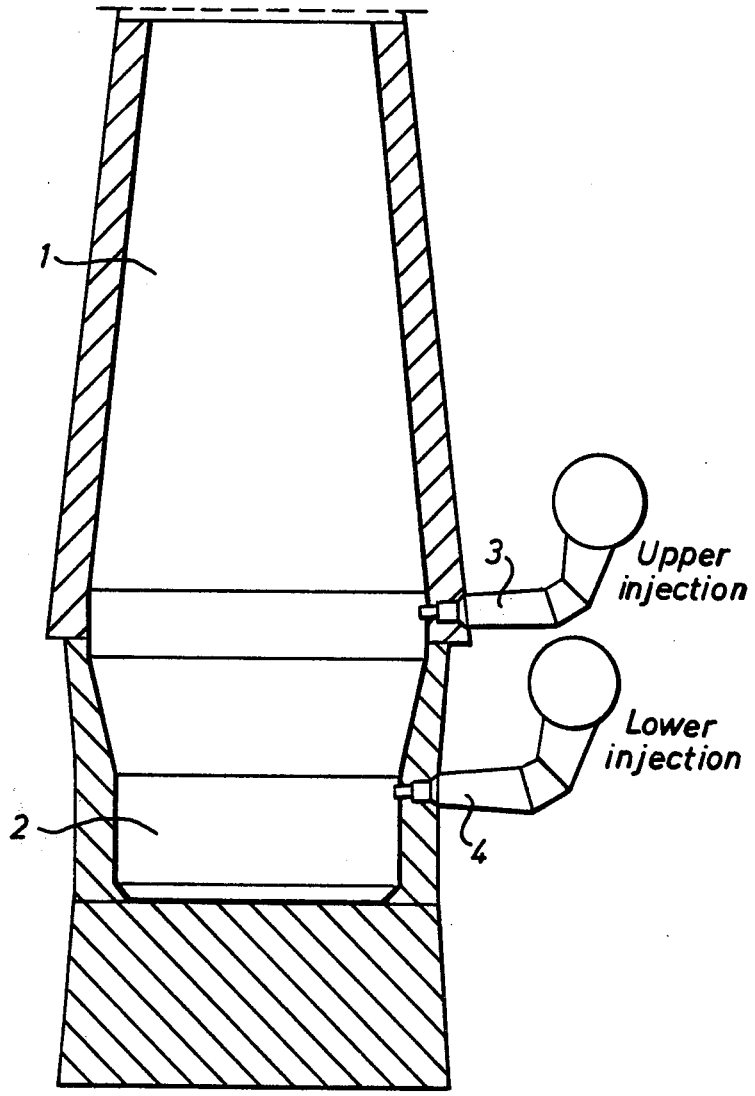
1
2
3
4
Upper injection
Lower injection

METHOD OF REDUCING ORE

The present invention relates to a method of reducing ore, particularly iron ore, in a shaft furnace (especially in a blast furnace) while decreasing coke consumption.

The present specification deals predominantly with iron ore but it will be obvious that what is described with reference to iron ore can also be applied to other ores which can be reduced in a shaft furnace, for example copper ore.

Iron oxides are reduced either directly ($FeO + C \rightarrow Fe + CO$) or indirectly ($Fe_xO_y + yCO \rightarrow x\,Fe + yCO_2$).

In blast furnaces operating in the traditional manner, coke plays a multiple role which can be briefly described as follows:

a. at the outlet of the tuyeres the blast reacts very rapidly with the coke according to the equation $C + \frac{1}{2}O_2 \rightarrow CO$. The hot gas produced at the outlet of the tuyeres satisfies the thermal requirements of the process and helps to create the conditions needed for reduction to take place. The quantity of coke burned in this way is between 60 and 70% of the coke rate.

b. the rising hot gas is insufficient to totally reduce the oxides in the charge. It follows that part of the oxides is directly reduced by the carbon in the coke. This extra amount of coke required in the conventional process is called "direct reduction coke."

c. in the case of iron, which forms stable carbides, a small amount of coke is required to carburize the molten metal. The amount of coke consumed by carburization is approximately 10% of the coke rate.

The total coke consumption in a blast furnace is the sum of partial consumptions from the three operations described above.

Coke is also very important mechanically because it provides a solid support, a coke grid, which allows gases and liquids (slag and iron) to counterflow. The coke grid does not in theory add to the coke consumption.

It has been recommended that coke consumption would be decreased by injecting into the furnace heating and reducing agents other than coke, for example liquid or gaseous hydrocarbons, at the level of and usually through the main tuyeres. These injections have reduced the amount of coke normally required by 5 to 20%.

When attempts were made to increase the quantities of the reducing and heating agents to be injected, it was noted that the temperature of the flames from the tuyeres dropped dramatically and/or a large quantity of the injected substances remained unburnt. The temperature of the blast and/or the oxygen content of the blast was increased in order to overcome these problems. The amount of coke needed in a conventional blast furnace operation was reduced by 25% using these additional methods.

In order to lower the coke consumption still further it has been recommended that there should be double injections, i.e. feeding hot reducing gases in at the level of the lower part of the reserve zone, and feeding reducing agents in at a level of the tuyeres. This method dispenses with much of the coke burned at the tuyeres and also much of the direct reduction coke, while still respecting the metallurgical essentials of the process, i.e. satisfying the thermal requirements and achieving the conditions necessary for chemical reduction in the furnace. The amount of coke saved using this method has reached levels of between 30 and 45% of the coke rate relative to the traditional operation.

The object of the present invention is a double injection method which dispenses with practically all the coke burnt at the tuyeres as well as the direct reduction coke and which limits the amount of coke in the charge to what is required for carburizing the molten metal and for forming the coke grid.

The invention provides a method of reducing ore in a furnace having a shaft in which a charge of ore and coke descends above a hearth in which molten metal and slag collect, the method comprising injecting a reducing gas at 800° to 1200°C continuously into the lower part of the shaft (whereby, for example, iron ore is reduced to FeO); and continuously injecting into the furnace, at the top of the hearth, a gas which is essentially chemicals inert to the contents of the furnace, the inert gas being at 1700° to 2500°C, whereby the thermal requirements for melting of the slag and the metal and for chemical reactions in the furnace are satisfied.

The hot reducing gas at 800° to 1200°C satisfies the thermal and chemical conditions required to maximize reduction of the charge with the lower region to the furnace. The gas which is inert and which is injected at the top of the hearth, the gas being at a temperature of 1700° to 2500°C, satisfies the thermal conditions necessary for melting and heating the metal and the slag and also for the minor reactions such as the reduction of silicon, manganese, phosphorus, and small residual quantities of metal oxides.

The invention will now be described in more detail, by way of example only with reference to the accompanying drawing showing a shaft furnace in section.

The furnace has a stack 1 above a hearth 2. Tuyeres 3 for injecting a hot reducing gas are directed into the lower part of the stack 1 and tuyeres 4 for injecting an inert gas at 1700° to 2500°C are directed into the top of the hearth 2. Ore (e.g. iron ore) and coke are fed continually into the top of the stack 1, together with fluxes, to form a change which descends in the stack 1. Molten metal and slag collect in the hearth 2 and are tapped periodically.

From heat transfer considerations the furnace can be divided into three zones: the upper heat-exchange zone, the reserve zone, and the lower heat exchange zone. In the reserve zone the temperatures of the gases and solids remain substantially constant and are practically the same. The temperature in this zone (about 1000°C in the iron blast furnace) is determined by the occurrence of strongly endothermic reactions. (A. POOS, "Blast Furnace Theory and Practice," proceedings of a symposium held by the John Percy Research Group in Process Metallurgy, Imperial College, London, published by the Institute of Mining and Metallurgy, 1967; B. I. KITAEV et al., *Heat Exchange in Shaft Furnaces*, Pergamon Press, 1967).

The reducing gas at 800° to 1200°C is preferably injected into the lower part of the reserve zone. Advantageously, the reducing gas may contain mainly CO and $H_2$, for example reformed gas, i.e. gas produced by partial oxidation or catalytic cracking of hydrocarbons (e.g. in the presence of water vapor) or by pyrolysis.

The inert gas to be injected at the top of the hearth (preferably level with the main tuyeres in a conventional blast furnace) can be raised to high temperatures by any known means, for example a burner, an electric arc torch, or preferably a plasma arc torch, immediately before injection.

The inert gas is preferably nitrogen and may contain chemically active impurities.

We claim:

1. A method of reducing ore in a furnace having a shaft comprising a stack in which a charge of ore and coke descends and a hearth below the stack in which molten metal and slag collect, the method comprising the steps of: feeding ore and coke continually into the top of the stack; tapping metal and slag continually from the hearth; continuously injecting a reducing gas at 800° to 1200°C into the lower part of the stack; and continuously injecting into the top of the hearth, a gas which is essentially chemically inert to the contents of the furnace, the inert gas being at 1700° to 2500°C, whereby the thermal requirements for melting of the slag and the metal and for chemical reactions in the furnace are satisfied by the reducing gas and the inert gas alone.

2. The method as claimed in claim 1, wherein the reducing gas is injected into the lower part of the reserve zone in the shaft.

3. The method as claimed in claim 1, in which the furnace is a blast furnace having tuyeres, the inert gas being injected at substantially the level of the tuyeres.

4. The method as claimed in claim 1, further comprising the step of raising the inert gas to be injected at the top of the hearth to 1700°–2500°C by means of a burner.

5. The method as claimed in claim 1 in which the inert gas is nitrogen.

6. The method as claimed in claim 1, further comprising the step of raising the inert gas to be injected at the top of the hearth to 1700°–2500°C by means of an electric arc.

7. The method as claimed in claim 1, further comprising the step of raising the inert gas to be injected at the top of the hearth to 1700°–2500°C by means of a plasma arc.

* * * * *